US005449058A

United States Patent [19]

Kotler et al.

[11] Patent Number: 5,449,058

[45] Date of Patent: Sep. 12, 1995

[54] COIN TESTING DEVICE

[75] Inventors: Martin Kotler, Douglas, Isle of Man; Michael D. Nunn, Berkshire, England

[73] Assignee: Mars, Incorporated, McLean, Va.

[21] Appl. No.: 182,147

[22] Filed: Feb. 28, 1994

[30] Foreign Application Priority Data

Jul. 18, 1991 [GB] United Kingdom ..... 9115455

[51] Int. Cl.[6] ..... G07F 1/04

[52] U.S. Cl. ..... 194/344; 194/345

[58] Field of Search ..... 194/344, 345, 350, 353; 193/DIG. 1

[56] References Cited

U.S. PATENT DOCUMENTS

| | | | |
|---|---|---|---|
| Re. 33,314 | 8/1990 | Cowles . | |
| 3,907,086 | 9/1975 | Willis | 194/344 X |
| 4,225,056 | 9/1980 | Flubacker . | |
| 4,458,187 | 7/1984 | Heiman . | |
| 5,082,099 | 1/1992 | Abe | 194/345 X |
| 5,316,120 | 5/1994 | Ibarrola | 194/345 X |

FOREIGN PATENT DOCUMENTS

| | | |
|---|---|---|
| 2006683 | 8/1971 | Germany . |
| 2123196 | 1/1984 | United Kingdom . |
| 2235558 | 4/1993 | United Kingdom . |
| WO91/01028 | 1/1991 | WIPO . |

*Primary Examiner*—Michael S. Huppert
*Assistant Examiner*—Scott L. Lowe
*Attorney, Agent, or Firm*—Davis Hoxie Faithfull & Hapgood

[57] ABSTRACT

A coin testing device comprising two parts carrying coin sensor elements, the two parts being capable of relative movement apart from each other for access to the space between them. When the parts are closed, their relative positioning is defined by features at four positions. At three of those positions the features are such as to determine the spacing between the two parts and at two of those positions the features are such as to prevent relative translational and rotational movement of the two parts in their own plane. A loose hinging arrangement is provided so that only the features of those four positions, and not features of the lid, determine the relative position of the two closed parts.

9 Claims, 4 Drawing Sheets

COIN TESTING DEVICE

FIELD OF THE INVENTION

This invention relates to coin testing devices.

BACKGROUND OF THE INVENTION

In the Applicant's published Application WO 91/01028 it was explained that it was important for each coin sensor element to be in a known predetermined position relative to the path of coins through the testing device, for the two sensor elements of a pair, when they are co-operating in pairs, to be accurately in register with each other and also to be accurately at a predetermined distance away from each other across the coin path and also, in some circumstances, for the opposed walls which define the coin path to be exactly a predetermined distance away from each other.

For the purposes of this application, as in the above-mentioned application, the term "sensor element" will be used to refer to a component which is mounted as a unit, whether it is a complete sensor as for example a single coil operating independently, or only part of a complete sensor as for example one of a pair of series or parallel connected coils, one of a pair of transmitter/-receiver coils, or one of a pair of transmitting/receiving optical devices.

The above-mentioned application also explained that the hinge joining the two main parts of a coin testing mechanism has normally had a major function in positioning the two parts relative to each other when they are closed, so that any dimensional variations occurring in the manufacture of the hinge or in its assembly, or any distortions in the hinge which might be caused during clumsy operation in use, have produced corresponding geometrical variations between one device and another, or in an individual device at different times, and this has caused variations in performance between one device and another and in the performance of an individual device at different times of its life.

The above-mentioned application described an embodiment (which to a large extent will be described herein so as to assist in a full understanding of the present invention) in which the final positioning of the two parts was influenced by the hinge and was determined entirely by location-defining features independently of the hinge. They determined the spacing between the parts at three positions spaced apart to form a triangle and, since there were only three such positions, no relative rocking of the two parts was possible. At two of the three positions, the parts made, at least ideally, point-to-point and point-to-line contact respectively so that the contact at these two positions would substantially prevent both translational and rotational movement of the two parts relative to each other in their own plane. At the third position, there was point-to-surface contact which had exclusively a spacing function. It was explained that the particular forms of these location-defining features enabled manufacturing tolerance to be accommodated with minimal resulting variation in the relative positions of the parts.

This was to a large extent successful, but it was found in practice that the location-defining features needed to be spaced quite widely apart so as to minimise the small extent to which the relative positions of the two parts could vary in the rotational sense in their own plane. It was then found that the pressure urging the two parts together within the triangle could cause undesired and unpredictable flexing of one of the parts thus partly nullifying the advantage achieved. Making the triangle smaller reduces this effect but permits an undesirable increase in the amount of rotational variation available.

SUMMARY OF THE INVENTION

An object of the present invention is to overcome this disadvantage of the earlier device.

The invention involves dissociating either completely or partly control of relative rotation and translation of the two parts from control of the spacing between them. The size of the triangle can then be optimised without reducing consistency of rotational position and, indeed, the latter can be improved while at the same time the triangle can be made smaller.

The invention provides a coin testing device comprising two parts which in an operating, closed, condition of the device define between them a narrow space in which coins travel edgewise, one or more coin sensor elements mounted on at least one of the parts, the two parts being movable apart from each other for access to the space between them, the two parts being provided with location-defining features which in combination are adapted to determine the spacing between the parts and substantially prevent relative translation and rotation of the parts in their own plane, characterised in that the spacing between the parts is determined by location-defining features at three positions spaced apart so as to form a triangle, that those location defining features which are adapted to prevent relative translation and rotation include features at at least one position outside the triangle, and that means is provided for urging the parts together at a location within the triangle.

In embodiments that will be described, the location-defining features are at four positions, at two of which translation and rotation are substantially prevented, and one of these two positions is also at one of said three positions. That is to say, at one of the three positions there are location-defining features designed so as to determine the spacing between the parts and either also substantially fix them against translation relative to each other (i.e. point-to-point type contact) or play a part in substantially fixing them against rotation relative to each other (i.e. using point-to-line type contact).

It is also possible in accordance with the invention for the location-defining features which cooperate to prevent rotation and translation to both be at completely different positions from the three positions which define the triangle, there then being five positions at which there are location-defining features.

Any suitable means may be used to urge the two parts together but, if a hinge is required, it should provide only loose coupling, as in the above-mentioned application. The looseness of the hinge then enables the location-defining features to act properly without being affected by the manufacturing variations in, or distortions arising from rough use of, the hinge itself.

BRIEF DESCRIPTION OF THE DRAWINGS

In order that the invention may more clearly be understood, a preferred embodiment will now be described, by way of example, with reference to FIGS. 7 and 8 of the accompanying diagrammatic drawings, but first for a fuller understanding the coin testing device of the prior art will be described with reference to FIGS. 1 to 6.

DETAILED DESCRIPTION OF THE INVENTION

The device shown in FIGS. 1 to 6 comprises two main parts which for convenience will be referred to as the body 2 and the lid 4, both being one-piece plastics mouldings. In the operating or closed condition of the device shown in FIG. 1 the body and lid define between them a narrow space 6 of substantially uniform width. By means of a suitable coin entry arrangement such as a cup or chute, as is well known, coins will be delivered to the device substantially vertically and edgewise into the left hand end of the narrow space 6 as viewed in FIG. 1.

Figure 1:
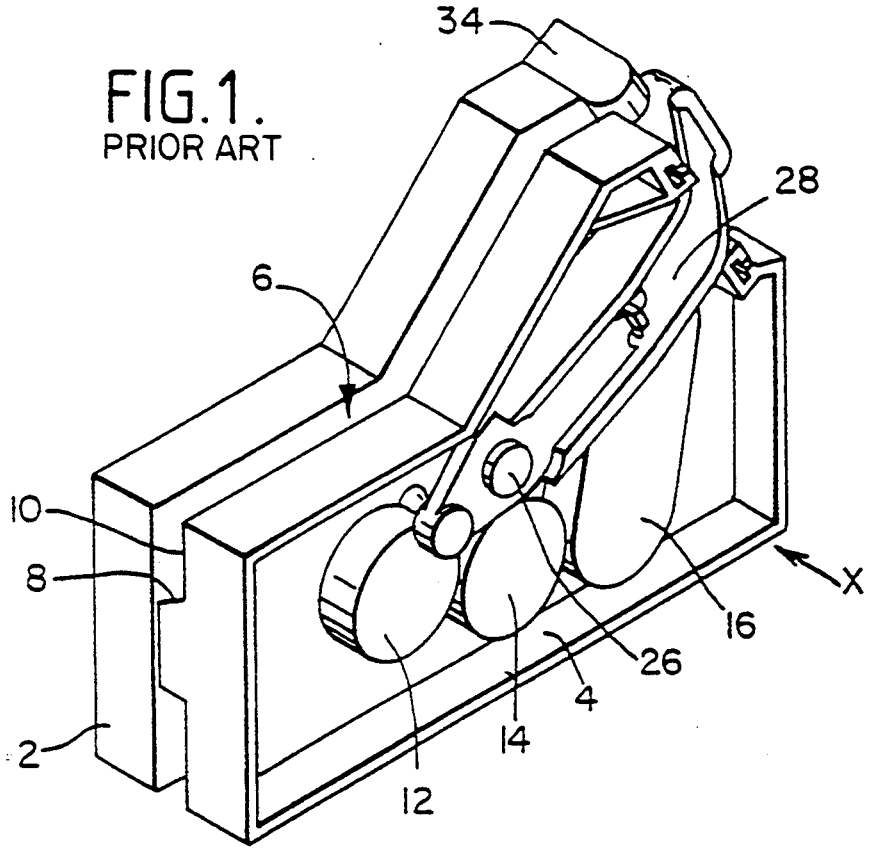
FIG.1. PRIOR ART
FIG. 1 is a perspective view of a coin testing device in accordance with the above-mentioned published application WO 91/01028.
Figure 3:
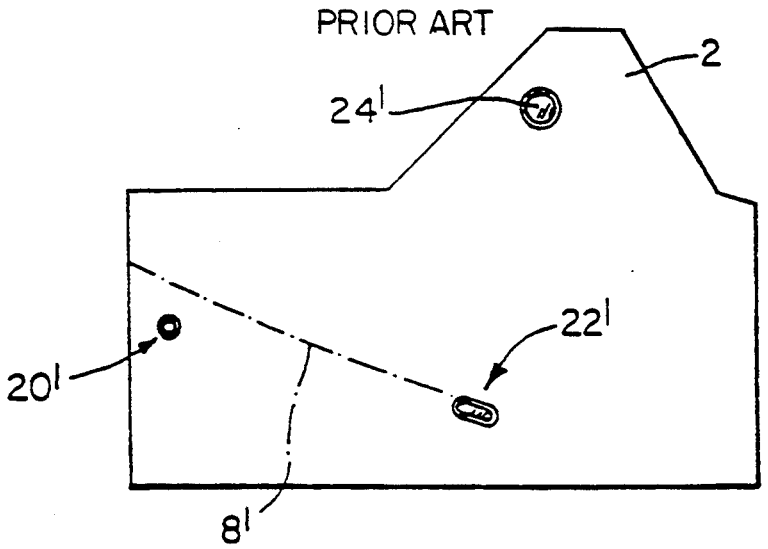
FIG.3. PRIOR ART
FIG. 3 is a plan view of the inner wall of one main part of the device.
Figure 2:
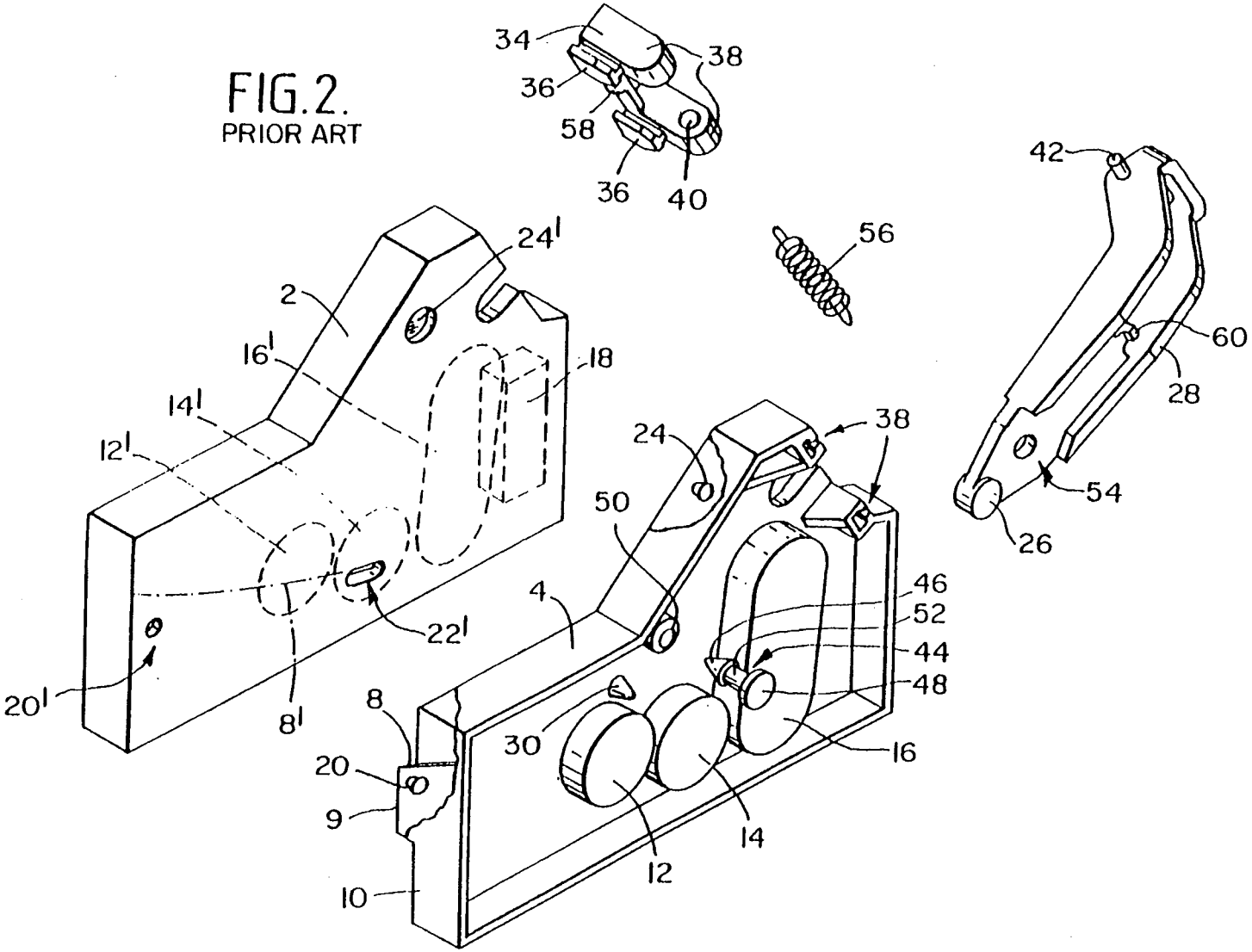
FIG. 2. PRIOR ART
FIG. 2 is an exploded view of the device shown in FIG. 1.
Figure 4:
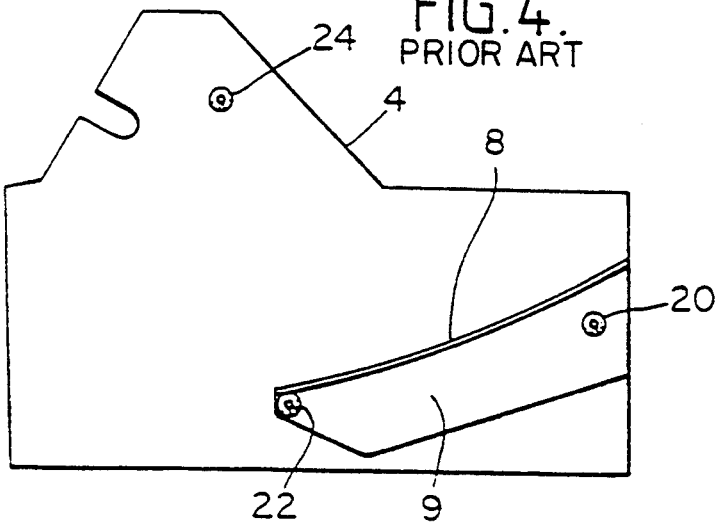
FIG. 4. PRIOR ART
FIG. 4 is a plan view of the inner wall of the other main part of the device.
Figure 5:
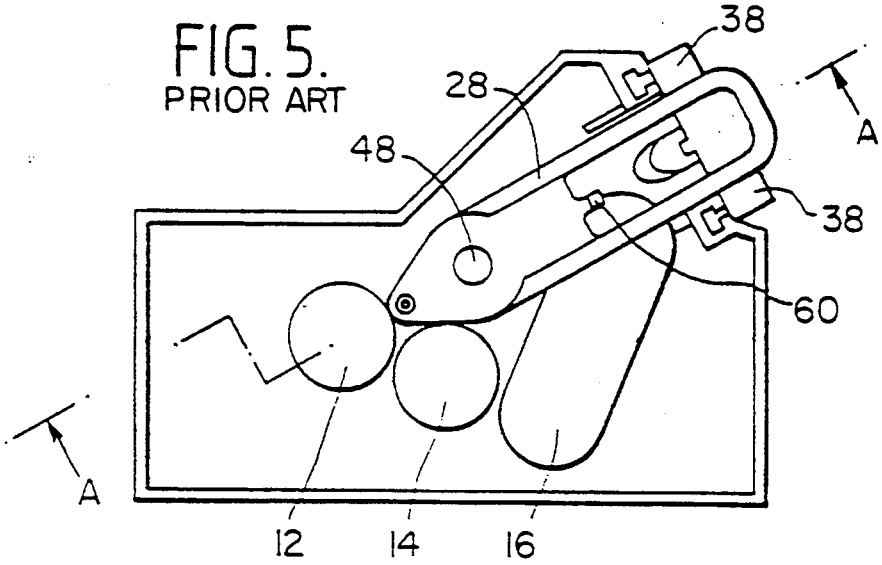
FIG. 5. PRIOR ART
FIG. 5 is an elevation taken in the direction of arrow X in FIG. 1.

The coin hits a coin track 8 which is the upper surface of a flat protrusion 9 moulded integrally on the inner wall 10 of the lid in known fashion (see also FIG. 4). Coin track 8 slopes downwards towards the right as seen in FIGS. 1 and 2, the position of the coin track relative to the body 2 being indicated by the broken line 8' in. FIGS. 2 and 3.

Three inductive sensor elements in the form of coils 12, 14 and 16 are mounted in conventional manner within the lid 4 on the back of its inner wall 10, at predetermined positions above the level of the coin track 8. Three further sensor elements in the form of coils indicated in broken lines 12', 14' and 16' are similarly mounted inside the body 2 and, as mentioned, when the device is assembled and in its operating condition it is desired for the sensor elements to be located precisely opposite each other in pairs 12, 12'; 14, 14'; and 16, 16'. The manner of operation of the sensor elements forms no part of the present invention, and therefore need not be described in further detail.

The body 2 and lid 4 contact each other only through location-defining features which are at three positions spaced apart to form a triangle. At the first position, the contact is between the sides of a flat-topped cone 20 integrally moulded on the lid 4 (in FIG. 2 the lid is shown as though partly transparent so as to illustrate the cone, and see also FIG. 6) and the sides of a conical recess 20' in the body 2. The conical angle of the recess is the same as that of the cone. The second contact is between the sides of a cone 22 the same as cone 20 and moulded on the inner wall 10 of the lid 4, and the walls of a linear or elongated recess 22' in body 2, this recess having sloping sides at an angle equal to the angle of the cone 22. The third contact is between the tip of a third-cone 24 the same as cones 20 and 22 moulded on the inner wall 10 of the lid 4, and a flat surface 24' which is the base of a recess in the body 2, but which might in fact be a part of the main surface of the body 2. The location-defining effect of the cones 20, 22 and 24, recesses 20' and 22' and surface 24' will be explained later, but it is mentioned here that ideally the three types of contact would be respectively point-to-point, point-to-line and point-to-surface. The use of small surfaces instead of points and a line closely approximates to this and is adopted to minimise the effects of wear on the components which are normally made of plastics.

The lid 4 is urged towards the body 2 at a position within the triangle, and indeed close to the centre of the triangle, by the free end 26 of a hinge arm 28 bearing on the tip of another integral cone 30 on the lid 4, via a bearing surface which is a concave surface 32 within the free end 26. This pressure, since it lies within the triangle formed by the three contact positions, insures that constant contact between the two parts is always made at those positions so long as the device is in its operating condition and so the alignment and spacing given by the three-position contact arrangement is maintained constant.

The hinge mechanism including the hinge arm 28 just referred to will now be further described. A hinge mounting 34 has two feet 36 of T-shaped cross-section as shown in FIG. 2 and these feet push into slots (not shown, but mirror images of the slots 38 indicated in the lid 4) in the back of body 2, thus fixing the hinge mounting 34 to the body 2. This fixing need not be highly accurate since as will become apparent it has no effect on the relative positioning of lid 4 and body 2 in the operating condition. The hinge mounting 34 has two arms 38 which on their inner sides are formed with opposed recesses 40 (only one visible in FIG. 2) into which fit pivot pegs 42 which project from opposite sides of the other end of the hinge arm 28, so that the hinge arm 28 is pivotally mounted to the body 2.

A peg 44 having a conical leading end 46 and a head 48 is a strong interference fit in a socket 50 moulded inside the lid 4 and the shank 52 of the peg 44 passes loosely through an aperture 54 intermediate the two ends of the hinge arm 28 and nearer to its free end 26. Thus, the peg 44 only loosely couples the lid 4 to the hinge arm 28. A tension spring 56 has one end hooked over a hook-like formation 58 which is integral with the hinge mounting 34 (see FIGS. 2 and 6) and the other end hooked over a hook 60 integral with the hinge arm 28.

Figure 6:
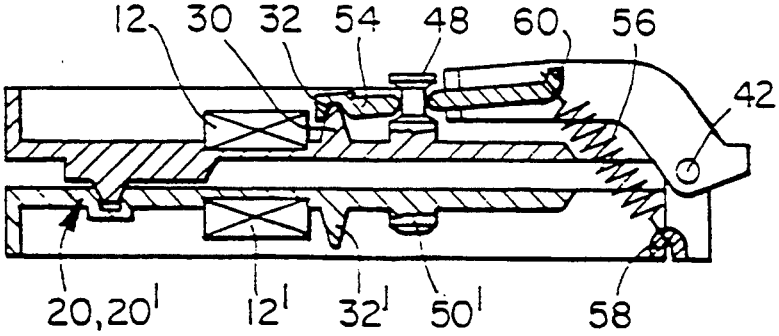
FIG. 6. PRIOR ART
FIG. 6 is a cross-section through the entire coin testing device in its FIG. 1 configuration, but taken along the line indicated for convenience at A—A in FIG. 5.

Spring 56 biasses the hinge arm 28 anti-clockwise as seen in FIG. 6 and hence the bearing surface 32 at the end of the hinge arm constantly presses on the cone 30 to maintain the three-position contact between the lid and the body. However, there is sufficient looseness between peg 44 and aperture 54, and sufficient play available between the cone 30 and bearing surface 32, that when the lid and body are being brought together from their open position they are sufficiently displaceable relative to each other that they are free to adopt final closed positions determined only by the contacts between the location-defining features. Consequently the hinge mechanism pays no part in determining the relative locations of the lid and body except simply to hold them together. The relative displaceability of the two parts could be achieved by not mechanically connecting them by a hinge at all. This would effectively be the case if the peg 44 were omitted, in which case lid 4 would be freely releasable from the body 2 and hinge arm 28 would serve only to apply a holding pressure.

The point-type contact at 20, 20′ determines completely the spacing between, and the relative positions of (both in the vertical and horizontal directions), the lid 4 and body 2 at that position. If, due to manufacturing variations, there is a slight variation in the distance between the tip of cone 20 and the tip of cone 22 on the lid, the cone 22 will still locate properly at some point along the length of elongated recess 22′, and because the longitudinal axis of the recess 22′ intersects recess 20′, this variation will not produce any variation in the angular orientation of lid 4 relative to body 2. If the axis of recess 22′ extends generally towards recess 20′ but does not actually intersect it, this angular invariability will still be partly, but not completely, achieved. Also, at contact 22, 22′ the spacing between lid 4 and body 2 is independent of the exact position at which cone 22 sits in recess 22′ because of the uniform linear nature of the recess, so spacing at this position is well controlled.

The only remaining freedom for relative movement is for rotation about the imaginary line joining recess 20′ and recess 22′ and such rotation is prevented by contact of the tip of cone 24 on flat surface 24′. There is the possibility of variations in the distance of cone 24 from cone 20 and also from cone 22 due to manufacturing inconsistencies, but the size and flatness of surface 24′, enable these variations to be accommodated without any "misfitting" occurring and without any tendency to disturb either the relative angles of lid 4 and body 2 or the spacing between them.

In the above description the term "freedom for relative movement" has been employed, which is a term well understood in the art. It will be appreciated that such relative movement does not occur in an individual coin testing device when it is in its closed or operating condition. What does occur is the accommodation of manufacturing tolerances which vary between the lids and bodies of different devices. The references to relative movement are believed to be a graphic and helpful way of indicating this.

In the above manner, and assuming that the six coils are correctly positioned in body 2 and lid 4, precise registration of each coil with the opposite one is ensured, the spacing between the two coils of each pair and also the spacing between each coil and the opposite wall of the narrow space 6 are precisely controlled, and the position, relative to body coils 12′, 14′ and 16′, of the path of a coin rolling on track 8 of lid 4 is precisely determined, all by the operation of the three-position contact arrangement described, and without being influenced by any variations in the manufacture of hinge mounting 34, hinge arm 28, their connections to the body 2 and lid 4, and their assembly together. It should be mentioned that the device is intended to be mounted at an inclination to the vertical so that coins roll on track 8 in constant contact with the inner wall of body 2 thus stabilising their path. This can also be achieved, as known, by mounting the device vertically but having the inner walls inclined within it.

It can been seen from FIGS. 1 and 2 that one pair of coils 16, 16′ are oval such that they can respond to the position, relative to the coin track, of the upper edge of the coin when it is centred between those coils. The coin will then, depending upon its diameter, occlude the coils from their lower limits up to the top edge of the coin so that the proportion of the coils occluded will depend upon the diameter of the coin. The fact that the linear contact 22, 22′ lies on an axis intersecting the point contact 20, 20′, and that line extends substantially in the same direction as the coin track, minimises in particular the extent to which manufacturing variations will adversely affect the operation of sensors of this type, which respond to the position relative to a sensor element, and in a direction generally perpendicular to the coin track, of a part of the coin. This is because the ability of variations in the spacing between cones 20 and 22 to cause relative rotation of lid and body about cone 20 in the plane of the coin path is eliminated so accurate relative positioning of a sensor element on one of them and the coin track on the other is improved.

When it is desired to open the lid 4 away from the body 2, the initial movement can be translation rather than pivotal movement, because of the limited amount of angular movement available between lid 4 and hinge arm 28 due to the loose coupling between them. This facilitates the release of stuck coins from between lid 4 and body 2 since they can be moved a limited distance apart, even at the hinge end, without the far end having to swing very far. This is an advantage in certain restricted locations where the testing device might be fitted. Further opening, for example for cleaning, requires that the lid 4 pivots round and up with the hinge arm 28 and eventually the centre of tension spring 56 passes through the axis of pegs 42 giving an over-centre action so that the spring can hold the lid 4 open at just over 90° to the body 2.

Figure 7:
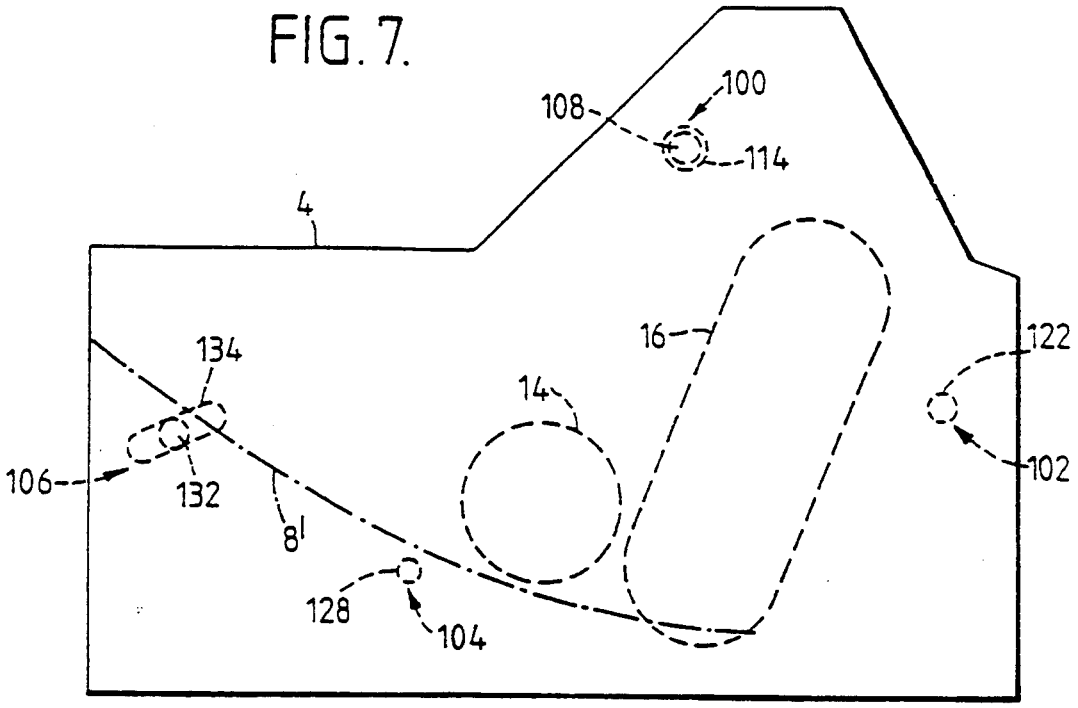
FIG. 7 shows a simplified view in the same direction as FIG. 5, but of a device in accordance with the invention, with certain internal features shown in broken or chain-dotted lines.
Figure 8:
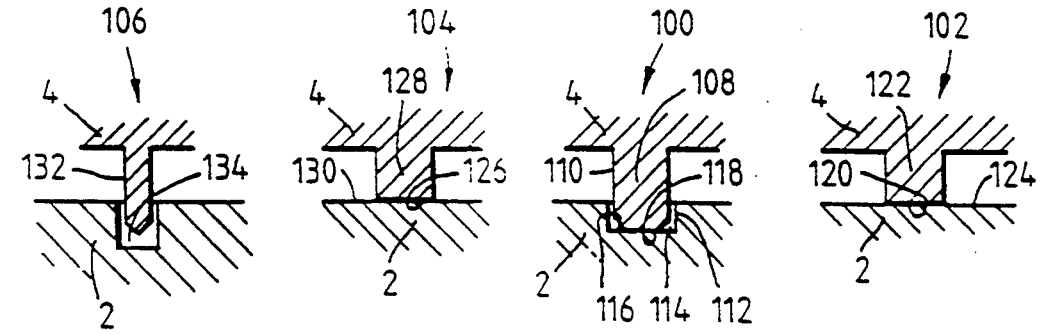
FIG. 8 shows in more detail and in cross-section the location-defining features of the device of FIG. 7.

Turning now to the invention, reference is now made to FIGS. 7 and 8 where the reference numerals 2, 4, 8′, 14 and 16 have the same significance as in the previous Figures. It is to be noted that in this embodiment there are only two sensors, comprising two pairs of sensor elements 14, 14′ and 16, 16′. Only the sensor elements 14 and 16 are indicated in the Figure, the other two sensor elements being located immediately behind them as viewed.

Location-defining features are at three positions, 100, 102 and 104, spaced apart so as to form a triangle, and also at a fourth position 106.

The location-defining features at position 100 comprise a peg 108 on the lid 4, which has a cylindrical outer surface 110 engaging with the cylindrical wall 112 of a recess 114 in the body 2, the recess 114 having a flat base 116 contacted by a flat end surface 118 on peg 108. The contact between surfaces 116 and 118 determines the spacing between the body and lid at this position. The peg 108 and recess 114 are dimensioned so that there is only very slight clearance (ideally there would be none) between the wall 112 and the cylindrical surface 110 of the peg 108. Contact between surfaces 110 and 112 does not influence the spacing between the lid and the body but substantially prevents any translational movement between them in the plane of FIG. 7, which is the plane of the lid and the body.

The location-defining features at position 102 comprise the flat end surface 120 of a peg 122 on the lid 4, engaging a flat surface 124 on the body 2. This determines the spacing between the lid and the body at this position but cannot influence relative rotation or translation between the body and the lid.

At position 104 the location defining features comprise a flat end surface 126 of a peg 128 on lid 4 contacting a flat surface 130 on body 2. These features act in the same way as the corresponding features at position 102.

The location-defining features at positions 100, 102 and 104 as just described are the only three that determine the spacing between lid 4 and body 2, so there is no possibility of rocking movement. Pressure to urge the two parts together within the triangle formed by these three positions may be applied by a loosely-coupled sprung hinge of the kind described in relation to FIGS. 1 to 6. Any variations in the distances between the pegs 108, 122 and 128, arising from manufacturing tolerances, have no effect upon the accuracy of spacing since the pegs contact flat surfaces 116, 124 and 130 which all lie in the plane of FIG. 7.

To substantially prevent relative rotation of lid 4 and body 2 about position 100, the location-defining features at position 106 comprise a peg 132 extending into, but not to the base of, a slot 134 in body 2. The slot 134 extends in the general direction of position 100 and its side walls are parallel and give only a slight clearance (ideally none) relative to the peg 132, so that relative rotation of the lid 4 and body 2 about position 100 is substantially prevented. It is to be noted that because peg 132 does not contact the base of slot 134 these features can have no influence on the spacing between the two parts. Because slot 134 extends generally towards position 100, any variations in the spacing between pegs 108 and 132 due to manufacturing tolerances will not affect the relative angular positions of the two parts.

It will be apparent that the triangle formed by positions 100,102 and 104 is smaller than that formed by the three contact positions in the device described with reference to FIGS. 1 to 6, and consequently any flexing of the lid or the body (or, indeed, any unwanted curvature of either arising from imperfection in the manufacturing techniques) will have less effect upon the spacing across the coin path between the sensor elements. It can additionally be seen that the distance between positions 100 and 106, where the features substantially preventing translational and rotational movement are located, is greater than that between features 20, 20' and 22, 22' in the device of FIGS. 1 to 6, so that the amount of unwanted residual relative rotational movement that can actually occur is reduced.

In a modification, the location-defining features at position 100 could be a peg and slot as at position 106, but with the peg contacting the base of the slot to provide a spacing function. Then, the features at position 106 would be similar to those shown at position 100, but with the peg 108 not contacting the base of its recess, so as to avoid disturbing the spacing.

This modified arrangement could be modified further by omitting the slot at position 100, and preventing rotation by providing two ribs contacting the sides of pegs at positions 100 and 102 respectively, the ribs extending towards position 106 and contacting opposite sides of the two pegs and thus, effectively, serving as the walls of a very wide slot with the two pegs engaging-opposite sides of the slot. The distance between the rotation-preventing features and the translation-preventing features would still be independent of the size of the triangle.

In a further modification the location-defining features at position 100 could be made the same as those at positions 102 and 104, and then the substantial prevention of translation and rotation would be achieved by providing, at a fifth position located remotely from position 106, location-defining features in the form of a peg on one part fitting with only slight clearance into a recess on the other part, so as to provide, in conjunction with peg 132 and slot 134 the required restraint against relative rotation and translation. The slot 134 would be re-aligned so as to extend generally towards this fifth position and, at the fifth position, the peg should not contact the base of the recess, thus avoiding any influence on the spacing between the parts.

The tip of peg 132 is conical and the tip of peg 108 has a chamfered edge, so that despite the looseness of the hinge, these can guide themselves correctly into the slot 134 and the recess 114 as the lid is being closed onto the body.

The embodiment of FIGS. 7 and 8 retains the advantages of the device shown in FIGS. 1 to 6, but has the extra advantages explained hereinbefore.

We claim:

1. A coin testing device comprising two parts which in an operating, closed condition of the device define between them a narrow space in which coins travel edgewise, one or more coin sensor elements being mounted on at least one of the parts, the two parts being movable apart from each other for access to the space between them, the two parts being provided with first and second location-defining features which in combination are adapted to determine the spacing between the parts and substantially prevent relative translation and rotation of the parts in their own plane, the spacing between the parts being determined by the first location-defining features being located at three positions spaced apart so as to form a triangle, the second location-defining features being adapted to prevent relative translation and rotation and being located at at least one position outside the triangle, and a bias element for applying pressure at a location within the triangle for urging the parts together.

2. A coin testing device as claimed in claim 1, wherein those second location-defining features, which are adapted to substantially prevent relative translation and rotation, are at two positions, and one of said two positions is also at one of said three positions and is also one of said first features.

3. A coin testing device as claimed in claim 2, wherein the second location-defining features at said one of said three positions substantially prevent translation.

4. A coin testing device as claimed in claim 2, wherein the second location-defining features at said one of said three positions substantially prevent rotation.

5. A coin testing device as claimed in claim 1, wherein those second location-defining features, which are adapted to substantially prevent relative translation and rotation, are at two positions, neither of which two positions is at any of said three positions.

6. A coin testing device as claimed in claim 5, wherein both of said two positions lie outside the triangle.

7. A coin testing device as claimed in claim 1 wherein those second location-defining features, which are adapted to substantially prevent translation and rotation, are at two positions, the second location-defining features at one of these two positions are adapted to substantially prevent translation, and the second location-defining features at the other of these two positions permit only linear movement along an axis which extends generally towards said one of these two positions.

8. A coin testing device as claimed in claim 1 wherein at least a major proportion of at least one of the one or more coin sensor elements lies within the triangle.

9. A coin testing device as claimed in claim 1 further comprising a hinge mechanism to enable the two parts to be swung apart from each other for access to the space between them, the hinge mechanism coupling the two parts loosely so that when the two parts are brought together from their apart position their final closed relative positions are determined by contact between said first and second location-defining features and not by the hinge mechanism.

* * * * *

UNITED STATES PATENT AND TRADEMARK OFFICE

CERTIFICATE OF CORRECTION

PATENT NO. : 5,449,058

DATED : September 12, 1995

INVENTOR(S) : Kotler et al.

It is certified that error appears in the above-indentified patent and that said Letters Patent is hereby corrected as shown below:

Cover page, in section [30] Foreign Application Priority Data, insert --Jul. 20, 1992 PCT/GB92/01331--.

Title page, item "[22] Filed: Feb. 28, 1994" should read --[22] PCT Filed: July 20, 1992--, and below item [22], please insert – [86] PCT No: PCT/GB92/01331

§ 371 Date: Feb. 28, 1994

§ 102e Date: Feb. 28, 1994

§ PCT Pub. No: WO91/01028

§ PCT Pub. Date: Feb. 4, 1993 –.

Col. 3, line 68, following the phrase "a third", delete "-".

Col. 7, lines 54-55, after "engaging", delete "-".

Signed and Sealed this

Second Day of September, 1997

*Attest:*

*Attesting Officer*

Bruce Lehman

BRUCE LEHMAN

*Commissioner of Patents and Trademarks*